US007234199B2

(12) United States Patent
Bushey

(10) Patent No.: US 7,234,199 B2
(45) Date of Patent: Jun. 26, 2007

(54) SELF ADJUSTING FURNITURE GUIDE

(76) Inventor: Richard D. Bushey, 1596 38th Ave., Kenosha, WI (US) 53140

( * ) Notice: Subject to any disclaimer, the term of this patent is extended or adjusted under 35 U.S.C. 154(b) by 0 days.

(21) Appl. No.: 10/686,923

(22) Filed: Oct. 16, 2003

(65) Prior Publication Data

US 2004/0123421 A1 Jul. 1, 2004

Related U.S. Application Data

(60) Provisional application No. 60/418,962, filed on Oct. 16, 2002.

(51) Int. Cl.
*B60B 33/00* (2006.01)

(52) U.S. Cl. ..... 16/42 R; 16/43; 248/188.9; 248/188.8

(58) Field of Classification Search ..... 16/42 R, 16/42 T, 43; 248/345.1, 346.11, 346.06, 248/346.07, 188.3, 188.9, 188.8; 403/107, 403/104, 106, 220, 223; 411/324, 913
See application file for complete search history.

(56) References Cited

U.S. PATENT DOCUMENTS 710,073 A * 9/1902 Pratt et al. ..... 135/86
960,700 A * 6/1910 Pratt ..... 135/84
1,603,876 A 10/1926 Shapard
D81,900 S * 8/1930 Wesley ..... D3/17
1,861,095 A 5/1932 Schacht
1,903,609 A * 4/1933 Uhl ..... 16/42 R
1,915,272 A 6/1933 Duncan, Jr.
1,921,561 A * 8/1933 Christmas ..... 248/188.9
1,982,138 A 11/1934 Herold
2,030,649 A 2/1936 Miller
2,262,063 A 11/1941 Swarr
2,262,064 A 11/1941 Swarr
2,457,723 A * 12/1948 Pura ..... 16/32
2,633,599 A 4/1953 Dolan
2,644,978 A 7/1953 Becker
2,710,027 A 6/1955 Husgen et al.
2,731,056 A * 1/1956 Anson ..... 16/86 A
2,753,586 A 7/1956 Metz
2,794,205 A 6/1957 Skupas
2,820,240 A 1/1958 Matys
2,840,113 A 6/1958 Simpson et al.
2,848,733 A 8/1958 Thornsbury
2,865,133 A 12/1958 Hoyen
2,875,552 A 3/1959 Stillman
2,878,509 A 3/1959 Fisher
2,902,794 A 9/1959 Ehrgott
2,933,754 A 4/1960 Winans
2,954,636 A 10/1960 Gammache
2,968,116 A 1/1961 Arenson
2,974,352 A 3/1961 Lockwood
2,988,770 A 6/1961 Arenson
2,992,509 A 7/1961 Gaenzle (Continued)

*Primary Examiner*—Brian E. Glessner
*Assistant Examiner*—Mark Williams
(74) *Attorney, Agent, or Firm*—Boyle Fredrickson Newholm Stein & Gratz S.C.

(57) ABSTRACT

A furniture glide is provided for mounting on the terminal end of a furniture leg having an outer surface. The furniture glide includes a base having a generally arcuate lower surface for engaging a supporting surface. A sleeve extends from the base and defines a cavity for receiving the furniture leg therein. The sleeve includes a leg engagement element for engaging the furniture leg received within the cavity and for retaining the furniture glide thereon.

9 Claims, 7 Drawing Sheets

U.S. PATENT DOCUMENTS 3,059,267 A 10/1962 Wilhelmi
3,078,498 A 2/1963 Morgan
3,177,518 A 4/1965 Bergstrom
3,183,545 A 5/1965 Bergstrom
3,191,212 A 6/1965 Reiss, Sr. et al.
3,342,445 A 9/1967 Bouwkamp
3,389,421 A 6/1968 Wheeler
3,505,724 A 4/1970 Leitner et al.
3,640,496 A 2/1972 Duncan
3,741,226 A * 6/1973 Urban ..... 135/84
3,845,924 A 11/1974 Taviere et al.
3,883,923 A 5/1975 England
4,327,460 A 5/1982 Wolff
4,468,910 A 9/1984 Morrison
D276,606 S 12/1984 Neuwirth
4,576,357 A 3/1986 Schrepfer
4,630,626 A * 12/1986 Urban ..... 135/84
4,644,610 A * 2/1987 Fish ..... 24/30.5 S
4,654,245 A 3/1987 Balzer et al.
5,005,374 A 4/1991 Bock
5,042,764 A 8/1991 Carpinella et al.
5,057,356 A 10/1991 Smith
5,081,740 A 1/1992 Smith
5,094,416 A 3/1992 Huon
5,170,972 A 12/1992 Guell
5,220,705 A 6/1993 Bushey
D339,560 S 9/1993 Byrd
5,299,883 A * 4/1994 Arth, Jr. ..... 404/10
D348,985 S 7/1994 Walker
D353,505 S 12/1994 Rea
5,426,818 A 6/1995 Bushey
5,469,599 A 11/1995 Wurdack
5,557,824 A 9/1996 Bushey
5,573,212 A 11/1996 Palazzolo
5,573,213 A 11/1996 Henderson et al.
D376,944 S 12/1996 Dunn
5,591,974 A 1/1997 Troyer et al.
D381,865 S 8/1997 Gallagher
5,680,673 A 10/1997 Beshore
5,782,444 A 7/1998 Anderman et al.
5,802,669 A 9/1998 Wurdack
D400,088 S 10/1998 Hurrie
5,945,178 A * 8/1999 Volkmann ..... 428/11
6,021,614 A * 2/2000 Krieger ..... 52/301
6,085,478 A * 7/2000 Workman ..... 52/301
6,088,877 A 7/2000 Swy et al.
6,154,923 A 12/2000 Carpinella
6,155,530 A * 12/2000 Borgen ..... 248/638
6,280,817 B1 8/2001 McCrossin et al.
6,324,725 B1 12/2001 Green
D455,383 S 4/2002 Sneed
6,405,982 B2 * 6/2002 Ferencz ..... 248/188.9
6,802,482 B2 * 10/2004 Harris ..... 248/188.9

* cited by examiner

FIG. 8
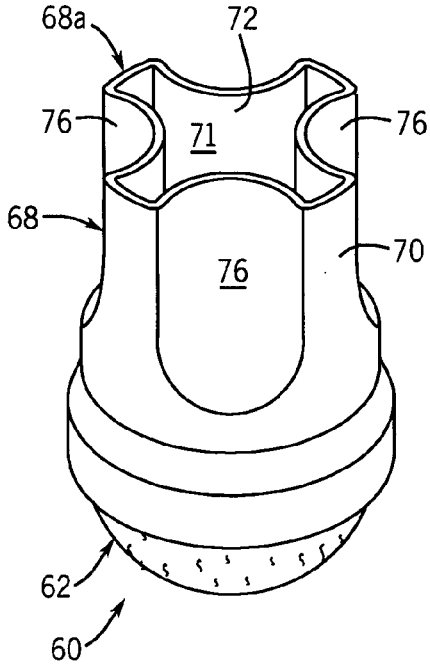
FIG. 9
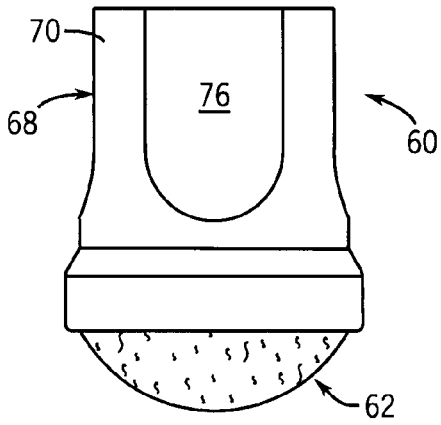
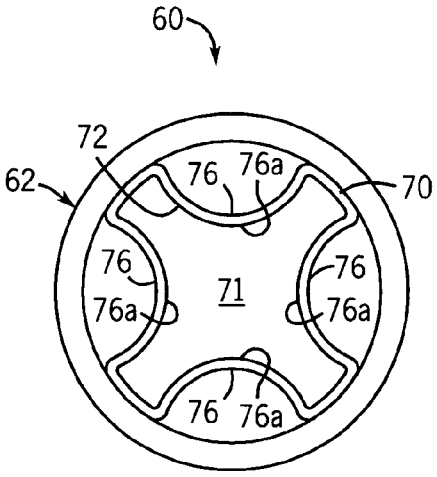
FIG. 10
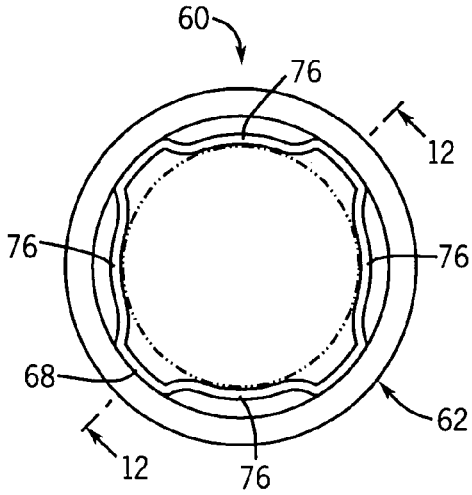
FIG. 11

FIG. 18
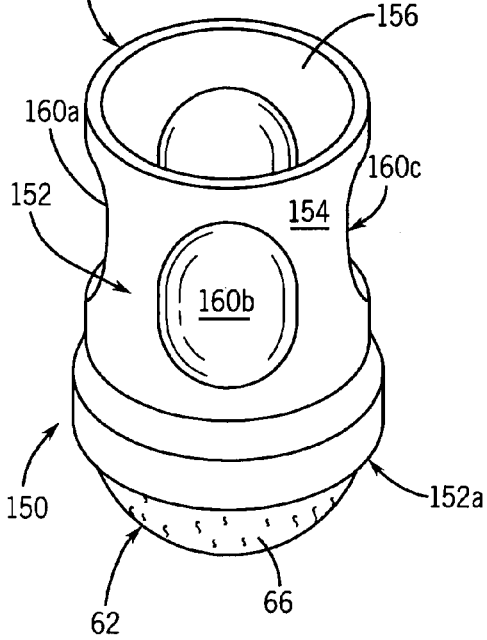
FIG. 19
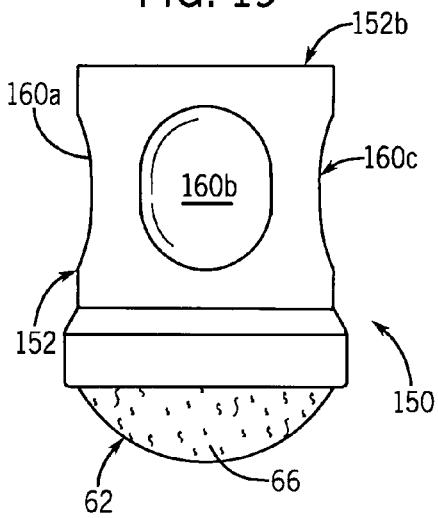
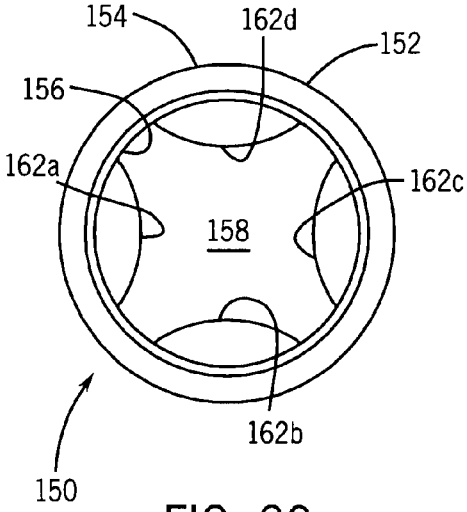
FIG. 20
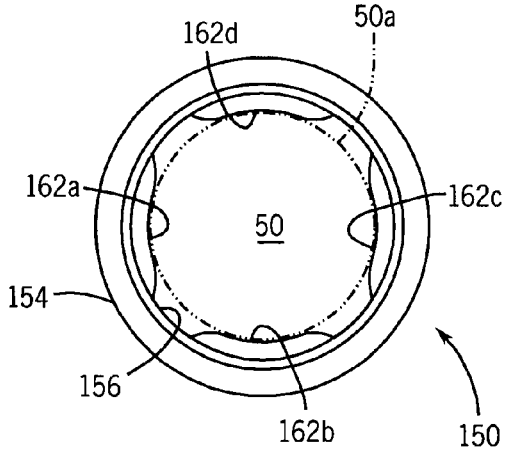
FIG. 21

SELF ADJUSTING FURNITURE GUIDE

CROSS-REFERENCE TO RELATED APPLICATION

This application claims the benefit of U.S. Provisional Application Ser. No. 60/418,962, filed Oct. 16, 2002.

FIELD OF THE INVENTION

This invention relates generally to furniture glides, and in particular, to a self-adjusting furniture glide that accommodates furniture legs of different shapes and sizes.

BACKGROUND AND SUMMARY OF THE INVENTION

Coasters are often used under the legs of a piece of furniture to act as a buffer between the legs and the floor on which the piece of furniture rests. Typically, coasters take the form of glass or rubber discs having flat bottoms that rest on the floor. By positioning the coasters between the furniture legs and the floor, the weight of the furniture leg is dispersed over a larger area such that the furniture leg does not scratch or mar the floor when the piece of furniture is moved or leave a depression in the floor when the piece of furniture remains in one place for an extended period of time.

In addition, furniture glides or sliders have been developed that are also positioned between the legs of a piece of furniture and the carpeting on which the piece of furniture rests. By way of example, Bushey, U.S. Pat. No. 5,220,705 discloses a furniture glide that facilitates the movement of a piece of furniture on carpeted and bare floors. The furniture glide includes a convo-convex disc having an arcuate convex lower surface, a concave upper surface defining a central cavity, and resilient pad fixed to the disc upper surface within the central cavity below the edge thereof. Adhesive is provided for securing the resilient pad to the bottom of the piece of furniture or to the leg of the piece of furniture.

While functional for its intended purpose, the furniture glide disclosed in the Bushey '705 patent has certain limitations. More specifically, repeated movement of a piece of furniture along a floor may cause the adhesive to fail such that the resilient pad becomes detached from the bottom of the piece of furniture. As a result, the furniture glide may become separated from the piece of furniture such that the bottom of piece of furniture may engage and damage the flooring. Therefore, it is highly desirable to provide a furniture glide and/or coaster that may be simply secured to a bottom of a piece of furniture to prevent damage to the flooring on which the piece of furniture rests.

Therefore, it is a primary object and feature of the present invention to provide a furniture glide that may be securely retained on a leg of a piece of furniture.

It is a further object and feature of the present invention to provide a furniture glide that is inexpensive to manufacture and simple to utilize.

It is a still further object and feature of the present invention to provide a furniture glide that may be utilized on the leg of a piece of furniture to prevent damage to the flooring on which the piece of furniture sits.

In accordance with the present invention, a furniture glide is provided for mounting on a terminal end of a furniture leg having an outer surface. The furniture glide includes a base having a generally arcuate lower surface for engaging a supporting surface and a sleeve extending from the base.

The sleeve defines a cavity for receiving the furniture leg therein. The sleeve has an adjustable portion for accommodating furniture legs of different dimensions within the cavity.

The adjustable portion of the sleeve includes a plurality of flexible depressions extending into the cavity. The depressions define corresponding inner surfaces for engagement with the furniture leg. It is contemplated that the depressions communicate with the upper edge of the sleeve. Alternatively, the adjustable portion of the sleeve may include a plurality of resilient projections extending radially inward from the upper edge of the sleeve for engaging the outer surface of the furniture leg and retaining the furniture leg in the cavity.

The base of the furniture glide may include a backing layer having an inner surface directed towards the cavity of the sleeve and an outer surface. A pad may be fixed to the outer surface of the backing layer to prevent marring of the supporting surface. The sleeve is generally tubular and includes an upper edge and a lower edge and is defined by an inner surface and an outer surface. The base may include an outer periphery affixed to the inner surface of the sleeve at the location adjacent the lower edge of the sleeve. Alternatively, the base may be affixed to the outer surface of the sleeve at a location adjacent the lower edge of the sleeve. The sleeve may also include a plurality of flutes formed therein that extend from the upper edge to the lower edge thereof. The plurality of flutes in the sleeve are generally parallel to each other.

In accordance with a further aspect of the present invention, a furniture glide is provided for mounting on the terminal end of a furniture leg having an outer surface. The furniture glide includes a base having a generally arcuate lower surface for engaging the supporting surface and an arcuate inner surface for engagement with the terminal end of the furniture leg. A sleeve extends from the base and has an inner surface that defines a cavity for receiving the furniture leg therein. The sleeve includes a leg engagement element for engaging the furniture leg within the cavity.

The leg engagement element may include a plurality of flexible projections that extend into the cavity to engage the furniture leg received in the cavity. The projections may intersect the upper end of the sleeve, or alternatively, project radially inward from the upper edge.

The base of the furniture glide may include a backing layer having an inner surface directed towards the cavity of the sleeve and an outer surface. A pad is affixed to the outer surface of the backing layer. The outer periphery of the base may be affixed to the inner surface of the sleeve at a location adjacent the lower edge thereof.

In accordance with a further aspect of the present invention, a furniture glide is provided for mounting on a terminal end of a furniture leg having an outer surface. The furniture glide includes a slider having a lower surface for engaging a supporting surface and an inner surface for engagement with the terminal end of the furniture leg. A leg connection member is interconnected to the slider and retains the furniture glide on the furniture leg.

The leg connection member includes a generally tubular sleeve having a plurality of flexible projections projecting from the inner surface thereof. The projections engage the furniture leg received in the cavity. The slider includes a backing layer having an inner surface for engagement with the furniture leg and an outer surface. A pad is affixed to the outer surface of the backing layer. The outer periphery of the slider may be affixed to the inner surface of the leg connection member at a location adjacent its lower edge. It is contemplated to provide a plurality of flutes in the leg connection member.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings:

FIG. 8 is an isometric view of a third embodiment of a furniture glide in accordance with the present invention;

FIG. 9 is a side elevational view of the furniture glide of FIG. 8;

FIG. 10 is a top plan view of the furniture glide of FIG. 8;

FIG. 11 is a top plan view, similar to FIG. 10, showing a furniture leg received in the interior of the furniture glide of FIG. 8;

FIG. 18 is an isometric view of a sixth embodiment of a furniture glide in accordance with the present invention;

FIG. 19 is a side elevational view of the furniture glide of FIG. 18;

FIG. 20 is a top plan view of the furniture glide of FIG. 18;

FIG. 21 is a top plan view showing the furniture glide of FIG. 18 received on a furniture leg.

DESCRIPTION OF THE PREFERRED EMBODIMENT

Figure 1:
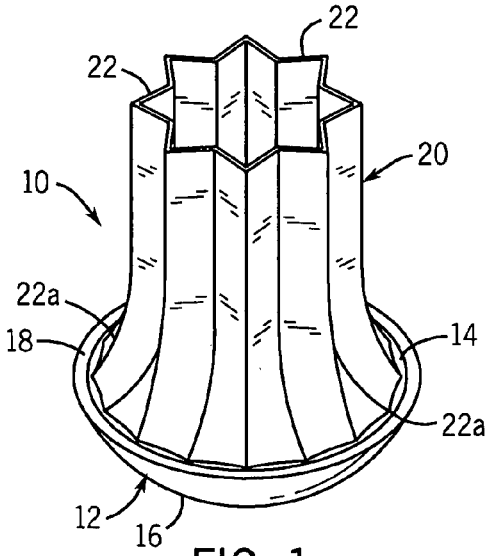
FIG. 1 is an isometric view of a first embodiment of a furniture glide in accordance with the present invention.
Figure 2:
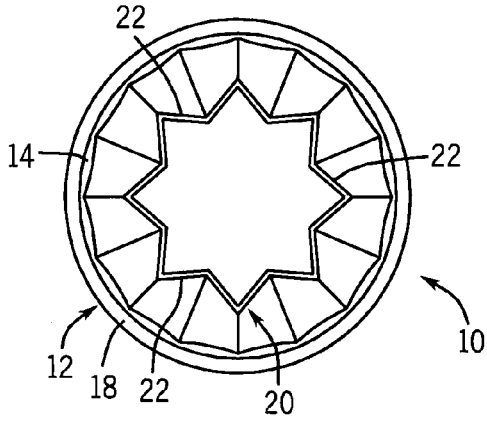
FIG. 2 is a top plan view of the furniture glide of FIG. 1.
Figure 3:
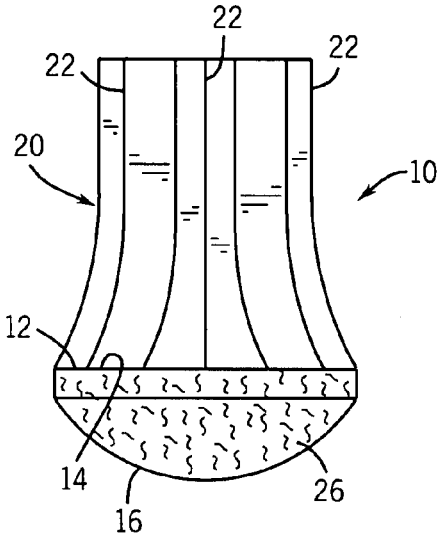
FIG. 3 is a side elevational view of the furniture glide of FIG. 1 having a felt pad positioned about the base thereof.
Figure 4:
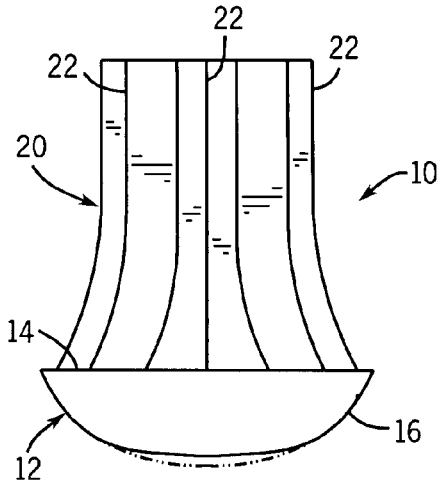
FIG. 4 is a side elevational view of the furniture glide of FIG. 1.

Referring to FIG. 1, a furniture glide in accordance with the present invention generally designated by the reference numeral 10. Furniture glide 10 includes a base 12 having a generally flat upper surface 14 and a generally arcuate floor engaging surface 16. As best seen in FIG. 4, floor engaging surface 16 of base 12 may terminate at a generally flat apex to facilitate the sliding of furniture glide 10 along a supporting surface, or an arcuate one, shown in phantom in FIG. 4. Rim 18 extends about the outer periphery of upper surface 14 of base 12. As best seen in FIG. 3, it is contemplated to cover base 12 of furniture leg 10 with felt pad 26. Felt pad 26 includes a dense plastic or rubber backing having heavy duty felt fused or glued to the plastic or rubber backing.

A hollow sleeve 20 extends vertically from upper surface 14 of base 12. Sleeve 20 extends along a longitudinal axis and includes a plurality of circumferentially spaced flutes 22 formed therein. Sleeve 20 defines interior 24 for receiving a chair leg or the like. It is contemplated that lower ends 22*a* of flutes 22 diverge radially from the longitudinal axis of sleeve 20. This allows the diameter of sleeve 20 to expand, FIG. 4. As described, by allowing sleeve 20 to be expandable, furniture legs of different shapes and sizes may be snuggly retained within interior 24 of sleeve 20. In addition, flutes 22 in sleeve 20 allow for furniture glide 10 to be simply and easily slipped onto and off of a furniture leg.

In operation, the terminal end of a furniture leg is inserted within interior 24 of sleeve 20 of furniture glide 10. Flutes 22 in sleeve 20 expand to accommodate furniture legs of different sizes and shapes and snuggly retain furniture glide 10 on the furniture leg. In such circumstances wherein furniture glide is used in conjunction with a furniture leg having an angled terminal end, it is preferred that the apex of floor engaging surface 16 of base 12 be arcuate such that a constant portion of floor engaging surface 16 remains in contact with a supporting surface such as the floor the like. As such, it is preferred to provide felt pad 26 over base 12. The felt pad over floor engaging surface 16 of base 12 spreads out the pressure points on floor engaging surface 16 of base 12. By rotating furniture glide 10 on terminal end of the furniture leg, prior unused portions of felt pad 26 may be used as portions of felt pad 26 wear out. As a result, the life of felt pad 26, and hence the furniture glide 10, may be extended.

Figure 5:
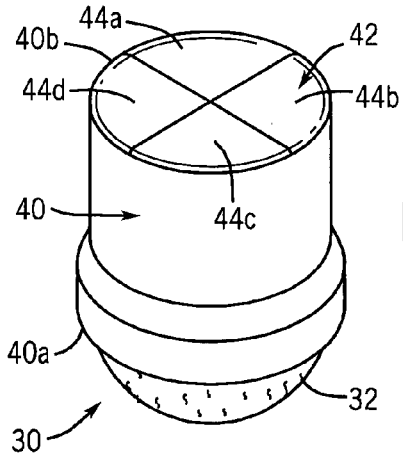
FIG. 5 is an isometric view of a second embodiment of a furniture glide in accordance with the present invention.
Figure 6:
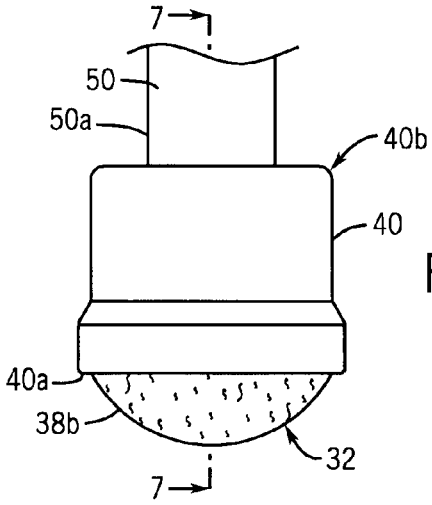
FIG. 6 is a side elevational view showing the furniture glide of FIG. 5 received on a furniture leg.
Figure 7:
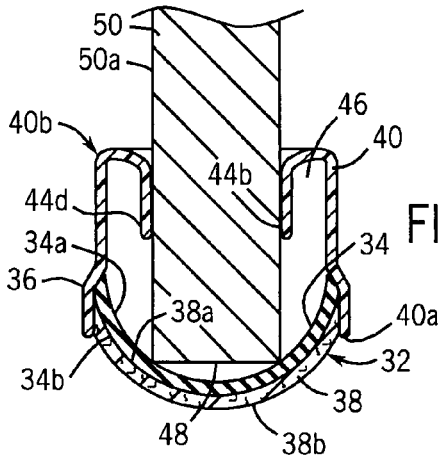
FIG. 7 is a cross-sectional view of the furniture glide of the present invention taken along line 7—7 of FIG. 6.
Figure 12:
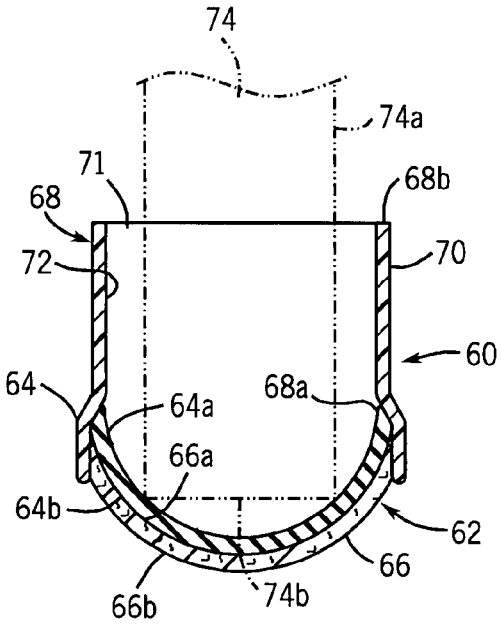
FIG. 12 is a cross-sectional view of the furniture glide of the present invention taken along line 12—12 of FIG. 11.

Referring to FIGS. 5–7, a second embodiment of a furniture glide in accordance with the present invention is generally designated by the reference numeral 30. Furniture glide 30 includes base 32 having backing portion 34 formed from a dense plastic or rubber material. Backing portion 34 includes a generally cup-shaped inner surface 34*a* and an arcuate outer surface 34*b*. It is contemplated to affix heavy duty felt 38 to outer surface 34*b* of backing portion 34. Felt 38 includes inner surface 38*a* fused or glued to outer surface 34*b* of backing portion 34*a* and outer surface 38*b* for slidably engaging a supporting surface such as the floor or the like.

A generally cylindrical sleeve 40 extends along a longitudinal axis, and includes a lower end 40*a* having an enlarged diameter defined by lip 36. Lip 36 in lower end of sleeve 40 is adapted for receiving the outer periphery of base 32. Retaining wall 42 closes upper end 40*b* of sleeve 40. Retaining wall 42 includes four resilient segments 44*a*–44*d* that project inwardly from upper end 40*b* of sleeve 40.

In operation, furniture leg 50 is inserted into interior 46 of sleeve 40 of furniture glide 30 such that terminal end 48 of furniture leg 50 engages inner surface 34*a* of backing portion 34 of base 32. As furniture leg 50 is inserted into interior 46 of sleeve 40, terminal end 48 of furniture leg 50 engages resilient portions 44*a*–44*d* of retaining wall 42. As furniture leg 50 is further inserted into interior 46 of sleeve 40, the upper surfaces of resilient portions 44*a*–44*d* of retaining wall 42 engage outer surface 50*a* of furniture leg 50 so as to snuggly retain furniture leg 50 within interior 46 of sleeve 40 of furniture glide 30.

Referring to FIGS. 8–13, a third embodiment of the furniture glide in accordance with the present invention is generally designated by reference numeral 60. Furniture glide 60 includes base 62 having generally arcuate backing portion 64. Backing portion 64 of base 62 includes a cup-shaped inner surface 64*a* and a generally arcuate outer surface 64*b*. Base 62 further includes heavy duty felt 66 having inner surface 66*a* fused or glued to outer surface 64*b* of backing portion 64 and outer surface 66*b* for engaging a floor or the like.

A generally cylindrical hollow sleeve 68 extends along a longitudinal axis and projects from base 62. Sleeve 68 includes outer surface 70 and inner surface 72 that is affixed to the outer periphery of base 62 adjacent lower end 68*a* of sleeve 68 by any suitable means such as glue or the like. Upper end 68*b* of sleeve 68 defines an opening for inserting furniture leg 74 into interior 71 of sleeve 68. Sleeve 68 further includes a plurality of circumferentially spaced depressions 76 adjacent upper end 68*b* thereof. Depressions 76 project into interior 71 of sleeve 68 and define resilient furniture leg engaging surfaces 76*a* for engaging and retaining furniture leg 74 within interior 71 of sleeve 68.

In operation, furniture leg 74 is inserted into interior 71 of sleeve 68 of furniture glide 60. Furniture leg engaging surfaces 76*a* of depressions 76 in sleeve 68 engage outer surface 74*a* of furniture leg 74 so as to resiliently retain furniture glide 60 on furniture leg 74. It can be appreciated that depressions 76 in sleeve 68 allow for furniture legs of various sizes and shapes to be inserted into interior 71 of sleeve 68. With furniture leg 74 fully received within interior 71 of sleeve 68 of furniture glide 60, terminal end 74*b* of furniture leg 74 engages inner surface 64*a* of backing portion 64 of base 62.

Figure 13:
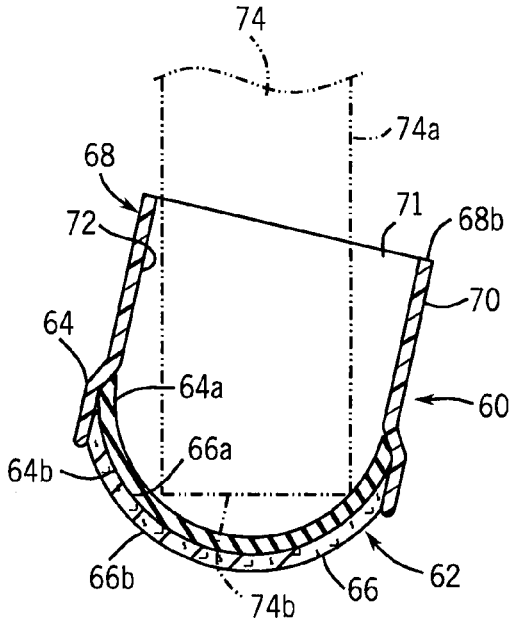
FIG. 13 is a cross-sectional view, similar to FIG. 12, showing the furniture glide of FIG. 8 mounted on a furniture leg at an angle thereto.

As best seen in FIG. 13, it can be appreciated that the structure of furniture glide 60 allows for furniture glide 60 to be mounted on a furniture leg 74 having an angled terminal end 74*b* or may be mounted at an angle to the longitudinal axis of furniture leg 74. As a result, a portion of lower surface 66*b* of felt 66 of base 62 will engage the supporting surface. In order to extend the life of furniture glide 60, the furniture glide 60 may be rotated on furniture leg 74 such that a prior unused portion of outer surface 66*b* of felt 66 of base 62 will engage the supporting surface. This, in turn, will extend the overall life of furniture glide 60.

Figure 14:
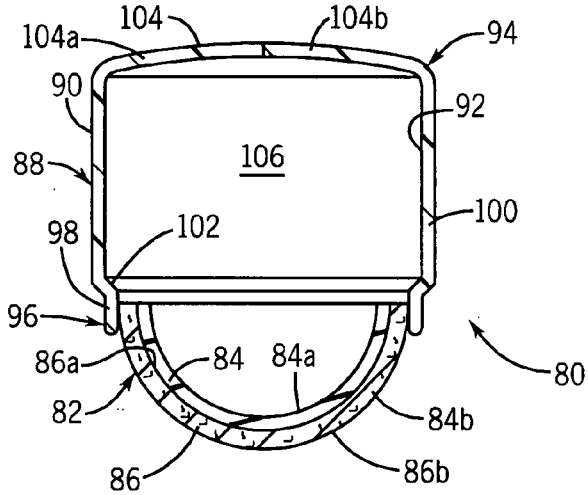
FIG. 14 is a cross-sectional view of a fourth embodiment of a furniture glide in accordance with the present invention.

Referring to FIG. 14, it is contemplated to modify furniture glide 60. The furniture glide in accordance with such modification is generally designated by the reference numeral 80. Furniture glide 80 includes base 82 having a generally arcuate backing portion 84. Backing portion 84 of base 82 includes a cup shaped inner surface 84*a* and a generally arcuate outer surface 84*b*. Base 82 further includes heavy duty felt 86 having inner surface 86*a* fused or glued to outer surface 84*b* of backing portion 84 and outer surface 86*b* for engaging a floor or the like. A generally cylindrical hollow sleeve 88 extends along a longitudinal axis and includes outer surface 90 and inner surface 92. Sleeve 88 also includes upper end 94, lower end 96, and a reduced diameter portion 98 adjacent lower end 96 thereof. Reduced diameter portion 98 intersects enlarged diameter portion 100 of sleeve 88 at shoulder 102. Outer surface 86*b* of base 82 is affixed to inner surface 92 of sleeve 88 adjacent lower end 96 thereof along reduced diameter portion 98. As heretofore described with respect to furniture glide 30, it is contemplated to provide retaining wall 104 with four resilient segments 104*a* and 104*b* that project inwardly from upper end 94 of sleeve 90.

In operation, furniture leg 60 is inserted into interior 106 of furniture glide 80 such that terminal end 48 of furniture leg 50 engages inner surface 84*a* of backing portion 84 of base 82. As furniture leg 50 is inserted into interior 106 of sleeve 80, terminal end 48 of furniture leg 50 engages resilient portions 104*a*–104*b* of retaining wall 104. As furniture leg is further inserted into interior 106 of sleeve 88, upper surface of resilient portions 104*a* and 104*b* of retaining wall 104 engage outer surface 50*a* of furniture leg 50 so as to securely retain furniture leg 50 within interior 106 of sleeve 88 of furniture glide 80.

Figure 15:
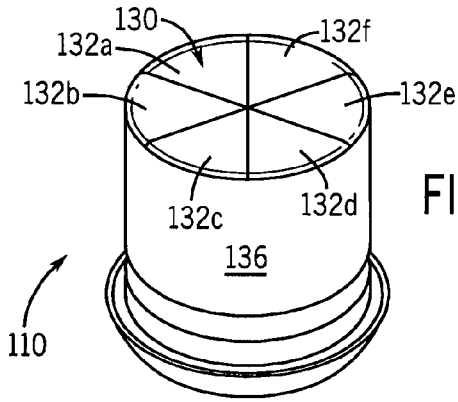
FIG. 15 is an isometric view of a fifth embodiment of a furniture glide in accordance with the present invention.
Figure 16:
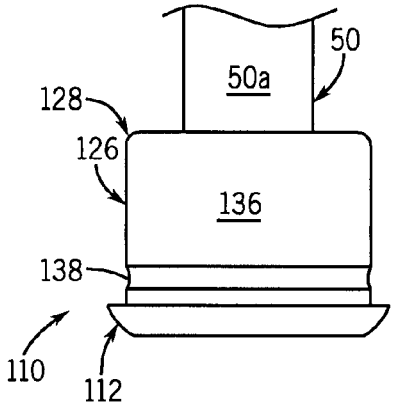
FIG. 16 is a side elevational view of the furniture glide of FIG. 15 received on a furniture leg.
Figure 17:
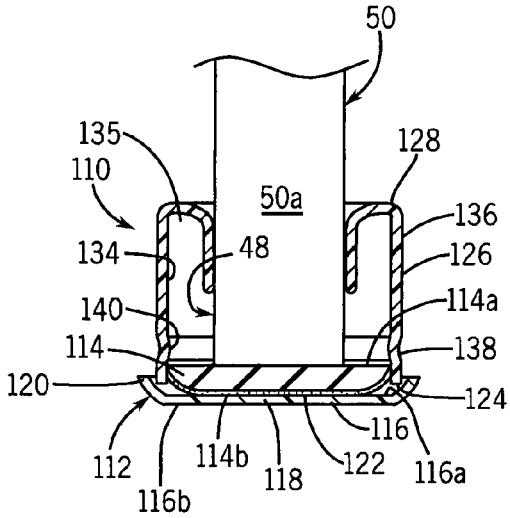
FIG. 17 is a cross-sectional view of the furniture glide of FIG. 16.
Figure 22:
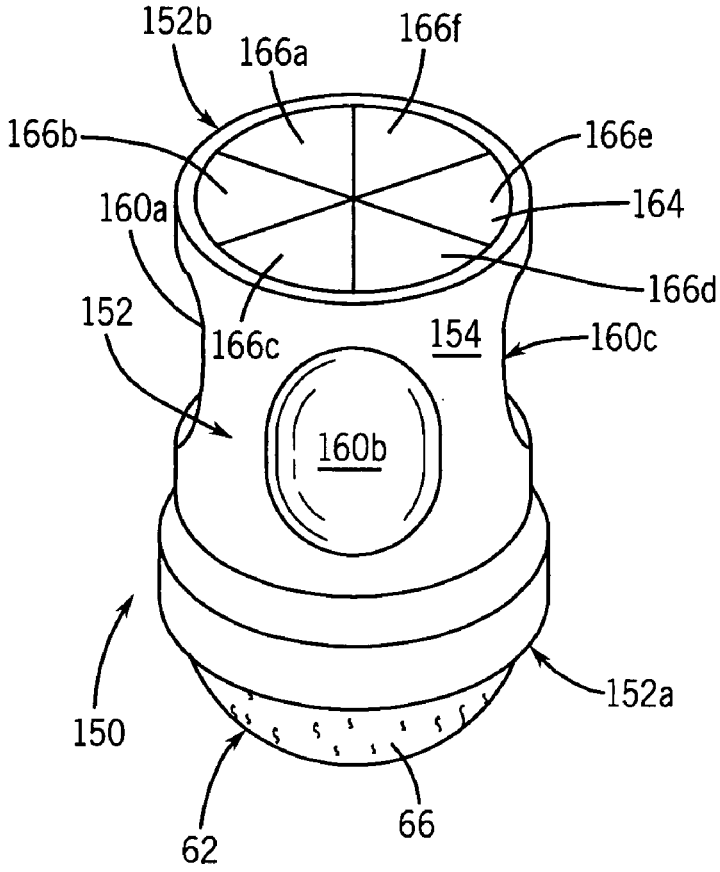
FIG. 22 is an isometric view of a seventh embodiment of a furniture glide in accordance with the present invention.

Referring to FIGS. 15–17, a still further embodiment of a furniture glide in accordance with the present invention is generally designated by the reference numeral 110. Furniture glide 110 includes slider 112 having a backing portion 114 formed from a dense plastic or a rubber material. Backing portion 114 includes upper surface 114*a* and lower surface 114*b*. Slider 112 further includes generally disc-shaped slider element 116 defined by upper surface 116*a* and lower surface 116*b*. Slider element 112 includes a generally flat, central disc portion 118 and an arcuate outer periphery 120. Upper surface 116*a* of slider element 112 is affixed to lower surface 114*b* of backing portion 114 by adhesive 122. As best seen in FIG. 17, outer periphery 120 of slider element 112 is radially spaced from the outer periphery of backing portion 114 of base 112 to accommodate lower end 124 of sleeve 126, as hereinafter described.

Generally cylindrical sleeve 126 extends along a longitudinal axis and includes upper end 128. Retaining wall 130 closes upper end 128 of sleeve 126 and includes resilient segments 132*a*–132*f* that project inwardly from upper end 128 of sleeve 126. Sleeve 126 further includes inner surface 134 that defines cavity 135 within the interior of sleeve 126 and outer surface 136. Recess 138 is formed in outer surface 136 so as to define shoulder 140 along inner surface 134 of sleeve 126. Shoulder 140 defines a reduced diameter portion of cavity 135.

As best seen in FIG. 7, backing portion 114 of slider element 112 is positioned within cavity 135 in sleeve 126 adjacent lower end 124 thereof. Shoulder 140 along inner surface 134 of sleeve 126 maintains backing portion 114 in position. In addition, adhesive 118 interconnects the outer periphery of backing portion 114 to inner surface 134 of sleeve 126.

In operation, furniture leg 50 is inserted into cavity 135 within the interior of sleeve 126 such that terminal end 48 of furniture leg 50 engages upper surface 114*a* of backing portion 114 of slider element 112. As furniture leg 50 is inserted into cavity 135 in sleeve 126, terminal end 48 of furniture leg 50 engages resilient portions 132*a*–132*f* of retaining wall 130. As furniture leg 50 is further inserted into cavity 135 within sleeve 126, the upper surfaces of resilient portions 132*a*–132*f* of retaining wall 130 engage outer surface 50*a* of furniture leg 50 so as snuggly retain furniture leg 50 within cavity 135 within sleeve 126 of furniture glide 110.

Referring to FIGS. 18–21, a still further embodiment of a furniture glide in accordance with the present invention is generally designated by the reference numeral 150. Furniture glide 150 includes base 62 as heretofore described. Generally cylindrical hollow sleeve 152 extends along a longitudinal axis and projects from base 62. Sleeve 152 includes outer surface 154 and inner surface 156 that is affixed to the outer periphery of base 62 adjacent lower end 152*a* of sleeve 152 by any suitable means such as glue or the like. Upper end 152*b* of sleeve 152 defines an opening for inserting furniture leg 50 into interior 158 of sleeve 152.

Sleeve 152 further includes a plurality of circumferentially spaced depressions 160*a*–160*c* (one not shown) that correspond to resilient projections 162*a*–162*d* that project into interior 158 of sleeve 152. Projections 162*a*–162*d* are provided for engaging and retaining furniture leg 50 within interior 158 of sleeve 152.

In operation, furniture leg 50 is inserted into interior 158 of sleeve 152 of furniture glide 150. Projections 162*a*–162*d* projecting into interior 158 of sleeve 152 engage outer surface 50*a* of furniture leg 50 so as to resiliently retain furniture glide 150 on furniture leg 50. It can be appreciated that projections 162*a*–162*d* extending into interior 158 of sleeve 150 accommodate for furniture legs of various sizes and shapes to be inserted into and snuggly retain within interior 158 of sleeve 152. With furniture leg 50 fully received within interior 158 of sleeve 152 of furniture glide 150, terminal end 48 of furniture leg 50 engages inner surface 64*a* of backing portion 64 of base 62.

Alternatively, furniture glide 150 may be modified such that retaining wall 164 closes upper end 152*b* of sleeve 152. Retaining wall 164 includes resilient segments 166*a*–166*f* that project inwardly from upper end 152*b* of sleeve 152. In operation, furniture leg 50 is inserted into interior 158 of sleeve 152 of furniture glide 150. As furniture leg 150 is inserted into interior 158 of sleeve 152, terminal end 48 of furniture leg 50 engages resilient portions 166*a*–166*f* of retaining wall 164. As furniture leg is further inserted into interior 158 of sleeve 152, the upper surfaces of resilient portions 166*a*–166*f* engage outer surface 50*a* of furniture leg 50 so as to snuggly retain furniture leg 50 within interior 158 of sleeve 152. In addition, projections 162*a*–162*d* extending into interior 158 of sleeve 152 engage outer surface 50*a* of furniture leg 50 so as to resiliently retain furniture glide 150 on furniture leg 50. With furniture leg 50 fully received within interior 158 of sleeve 152, terminal end 48 of furniture leg 50 engages inner surface 60*a* of backing portion 64 of base 62.

Various modes of carrying out the invention are contemplated as being within the scope of the following claims particularly pointing out and distinctly claiming the subject matter which is regarded as the invention.

I claim:

1. A furniture glide removably mountable on the terminal end of a furniture leg having an outer surface, comprising:

a base having a generally arcuate lower surface for engaging a supporting surface;

a sleeve extending from the base along an axis and having an inner surface defining a cavity for receiving the furniture leg, and terminating at an upper edge;

an adjustable portion of the sleeve, the adjustable portion including a plurality of flexible depressions extending into the cavity, the depressions defining corresponding inner surfaces for engagement with the furniture leg; and a plurality of flexible, resilient projections extending radially inward from the upper edge of the sleeve so as to define an upper limit of the cavity defined by the sleeve, each resilient projection having an upper surface and a lower surface;

wherein the plurality of resilient projections are movable between a first position wherein the upper surfaces of the resilient projections lie in a generally common plane and a second position wherein:

the upper surfaces of the resilient projections are engageable with the outer surface of the furniture leg with the furniture leg received in the cavity of the sleeve;

the resilient projections retain the furniture leg received in the cavity; and the resilient projections space the furniture leg received in the cavity from the inner surface of the sleeve so as to allow the furniture leg to be supported within the cavity at an acute angle to the axis.

2. The furniture glide of claim 1 wherein the base includes:

backing layer having an inner surface directed towards the cavity of the sleeve and an outer surface; and a felt pad affixed to the outer surface of the backing layer.

3. The furniture glide of claim 1 where base includes an outer periphery, the outer periphery of the base being affixed to the inner surface of the sleeve at a location adjacent the lower edge.

4. A furniture glide removably mountable on a terminal end of a furniture leg having an outer surface, comprising:

a base having a generally arcuate lower surface engageable with a supporting surface and an arcuate inner surface engageable with the terminal end of the furniture leg; and a sleeve extending along an axis from the base and having and upper edge and an inner surface defining a cavity for receiving the furniture leg, the sleeve including a leg engagement element having a plurality of flexible projections, each projection:

having an upper surface and a lower surface; and projecting from the upper edge of the sleeve;

an adjustable portion of the sleeve, the adjustable portion including a plurality of flexible depressions extending into the cavity, the depressions defining corresponding inner surfaces for engagement with the furniture leg; and wherein the projections are movable between a first position wherein the upper surfaces of the projections are generally co-planer with the upper edge of the sleeve and a second position wherein the upper surfaces of the projections are engageable with the outer surface of the furniture leg with the furniture leg received in the cavity and space the furniture leg received in the cavity from the inner surface of the sleeve so as to allow the furniture leg to be supported within the cavity of the sleeve at an acute angle to the axis.

5. The furniture glide of claim 4 wherein the sleeve terminates at an upper edge and wherein the projections intersect the upper edge of the sleeve.

6. The furniture glide of claim 4 wherein the base includes:

backing layer having an inner surface directed towards the cavity of the sleeve and an outer surface; and a felt pad affixed to the outer surface of the backing layer.

7. The furniture glide of claim 4 wherein the sleeve is generally tubular and includes an upper edge and a lower edge and wherein the base includes an outer periphery, the outer periphery of the base being affixed to the inner surface of the sleeve at a location adjacent the lower edge.

8. A furniture glide removably mountable on a terminal end of a furniture leg having an outer surface, comprising:

a slider having a lower surface for engaging a supporting surface and an inner surface for engagement with the terminal end of the furniture leg; and a leg connection member interconnected to the slider for retaining the furniture glide on the furniture leg, the leg connection member including:

a generally tubular sleeve extending along an axis and terminating at an upper edge, the tubular sleeve having an inner surface defining a cavity;

an adjustable portion of the sleeve, the adjustable portion including a plurality of flexible depressions extending into the cavity, the depressions defining corresponding inner surfaces for engagement with the furniture leg; and a plurality of flexible projections projecting from the upper edge of the sleeve, the projections having upper and lower surfaces and being movable between a first position wherein the projections lie in a generally common plane with the upper edge of the sleeve and wherein the projections at least partially close an upper end of the cavity and a second position wherein the upper surfaces of the projections are engageable with the furniture leg received in the cavity such that the projections are urged into the cavity by the furniture legs and such that the furniture leg is spaced by the projections from the inner surface of the sleeve so as to allow the furniture leg to be supported within the cavity of the sleeve at an acute angle to the axis.

9. The furniture glide of claim 8 wherein the slider includes:

a backing layer having an inner surface for engagement with the furniture leg and an outer surface; and a pad affixed to the outer surface of the backing layer.

* * * * *